US005794904A

United States Patent [19]

Hackley

[11] Patent Number: 5,794,904

[45] Date of Patent: Aug. 18, 1998

[54] HOLDER FOR INVERTED BOTTLES

[76] Inventor: Carl L. Hackley, 9214 Bright Leaf Pl., Charlotte, N.C. 28269

[21] Appl. No.: 563,441

[22] Filed: Nov. 28, 1995

Related U.S. Application Data

[63] Continuation-in-part of Ser. No. 288,833, Aug. 11, 1994, abandoned.

[51] Int. Cl.[6] ..... A47K 1/08

[52] U.S. Cl. ..... 248/311.3; 248/94; 248/312.1

[58] Field of Search ..... 248/94, 311.3, 248/312, 312.1, 346.03, 346.11, 311.2; 141/106, 364, 369, 375; D7/619; 220/23.86, DIG. 6, 737

[56] References Cited

U.S. PATENT DOCUMENTS

| | | | |
|---|---|---|---|
| 256,251 | 4/1882 | Sterling | 248/346.03 |
| 470,437 | 3/1892 | McElhiney | 248/346.03 |
| 1,303,171 | 5/1919 | Curtin | 248/346.11 |
| 2,372,872 | 4/1945 | Wolper | 248/94 |
| 2,883,057 | 4/1959 | Richards | 248/94 |
| 3,393,892 | 7/1968 | Buck | 248/346.11 |
| 4,552,275 | 11/1985 | Chang | 248/346.03 |
| 4,789,017 | 12/1988 | Panasewicz | 248/94 |

FOREIGN PATENT DOCUMENTS

| | | | |
|---|---|---|---|
| 203124 | 5/1938 | Switzerland | 248/311.3 |

*Primary Examiner*—Leslie A. Braun
*Assistant Examiner*—Gwendolyn W. Baxter
*Attorney, Agent, or Firm*—Clifton Ted Hunt

[57] ABSTRACT

This invention is a holder for inverted bottles of different sizes and shapes. Two embodiments are provided. One embodiment is intended to support opened bottles for drainage of the contents from the bottle. The other embodiment is intended to support closed or capped bottles that are inverted to collect a portion of the contents in the neck of the bottle for easy access when the bottle is opened by removing the cap.

3 Claims, 4 Drawing Sheets

HOLDER FOR INVERTED BOTTLES

CROSS REFERENCE TO RELATED APPLICATION

This application is a continuation-in-part of my application Ser. No. 08/288,833 filed Aug. 11, 1994, now abandoned, for INVERTED BOTTLE HOLDER, which mistakenly identifies the inventor as Carl Hacilley, whereas the correct name of the inventor in said co-pending application Ser. No. 08/288,833 is Carl L. Hackley, the present applicant.

FIELD OF THE INVENTION

This invention relates to an apparatus for use with different sizes and shapes of bottles containing fluids, particularly viscous fluids such as catsup.

BACKGROUND OF THE INVENTION

The desirability of draining the residue from near-empty bottles of catsup, honey and other viscous liquids has long been recognized. It is also known to provide holders for full and partially filled bottles that have been closed and inverted to position the contents of the bottle near the closed opening so the contents will be readily available when the bottle is returned to its upright position and opened for use.

The current interest in the environment provides another reason for providing a holder to be used for draining the residue of viscous liquids. It is, of course, preferable that bottles to be recycled be clean. The cleaning of viscous liquids such as catsup from bottles is a time consuming process and that fact discourages some people from recycling such bottles. Instead, they throw them in the trash. The cleaning of the bottle is easier after gravity has removed most of the residue from an inverted bottle.

There are several patents showing holders for inverted bottles, of which Applicant is aware of the following:

Deadwyler, Jr. are subject to failure sooner than the relatively rigid holder of the present invention.

SUMMARY OF THE INVENTION

The bottle holder of the present invention is preferably formed from a sturdy and rigid plastic, such as high density polythene. One embodiment of the invention is for use with an opened bottle that has been inverted for use. This embodiment comprises three pieces that nest together in a compact manner for shipping and storage but can be easily assembled for use with virtually any bottle. When erected for use, the holder has a circular base with a closed bottom, a circular and tapered mid-section, and a generally funnel-shaped upper portion with diametrically opposed flanges that serve as auxiliary receptacles for the shoulders of bottles with generally rectangular body portions.

A second embodiment is intended for use with a closed bottle that has been inverted to move the contents into the neck of the bottle. This second embodiment comprises two pieces that nest together for storage and shipment and can also be easily assembled for use with virtually any bottle. The second embodiment has an open ended circular base and the same generally funnel-shaped upper portion with diametrically opposed flanges as in the first embodiment.

| PATENT NO. | ISSUE DATE: | INVENTOR: | TITLE: |
|---|---|---|---|
| 4,271,878 | June 9, 1981 | Bologa | LIQUID TRANSFER DEVICE |
| 4,960,254 | Oct 2, 1990 | Hartke | PORTABLE HOLDER TO SUPPORT A RECAPPED CONTAINER OF EFFERVESCENT LIQUID IN AN LIQUID IN AN INVERTED POSITION TO RETAIN THE LIQUIDS FRESHNESS |
| 5,071,002 | Dec 10, 1991 | Bradley | INVERTIBLE HOLDER FOR CONTAINERS |
| 5,080,150 | Jan 14, 1992 | Deadwyler, Jr. | CONDIMENT BOTTLE DRAINING BASKET |
| 5,105,860 | Apr 21, 1992 | Connor | APPARATUS FOR DRAINING FLUID CONTAINERS |
| 5,146,957 | Sep 15, 1992 | Belokis, Jr. | NESTABLE CONTAINER AND METHOD FOR DISPENSING AND DRAINING LIQUID THEREFROM |
| Des. 332,551 | Jan 19, 1993 | Fields | HOLDER FOR INVERTED BOTTLES |
| Des. 333,265 | Feb 16, 1993 | Lindsey | HOLDER FOR INVERTED BOTTLES |
| 5,215,133 | June 1, 1993 | Lambert | DEVICE FOR SUPPORTING A LIQUID CONTAINER |
| Des. 342,866 | Jan 4, 1994 | Lee | CATSUP BOTTLE DRAIN RACK |
| 5,297,600 | Mar 29, 1994 | Downes | CONTAINER EMPTYING DEVICE |

Figure 5:
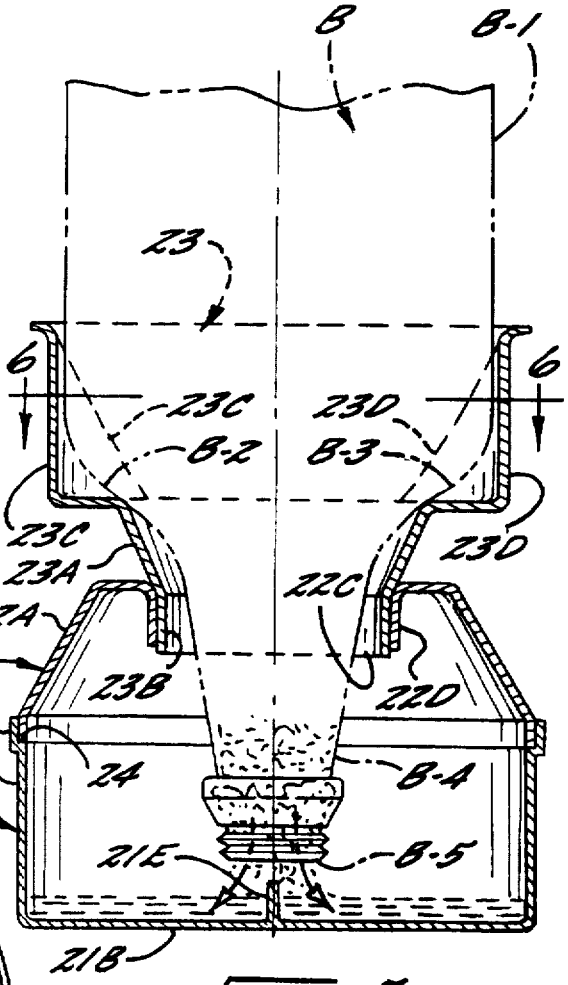
FIG. 5 is a sectional view taken substantially along the line 5—5 in FIG. 4 and showing the assembled parts of the holder supporting an inverted bottle shown in phantom lines.
Figure 6:
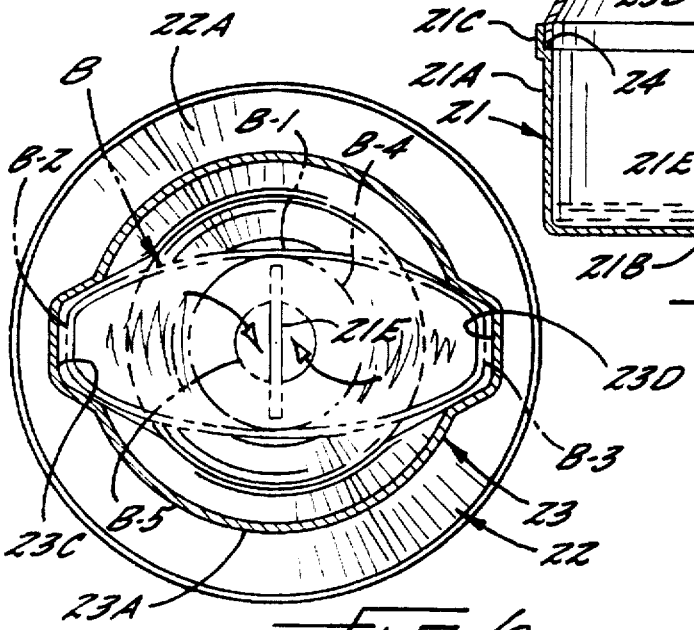
Figure 7:
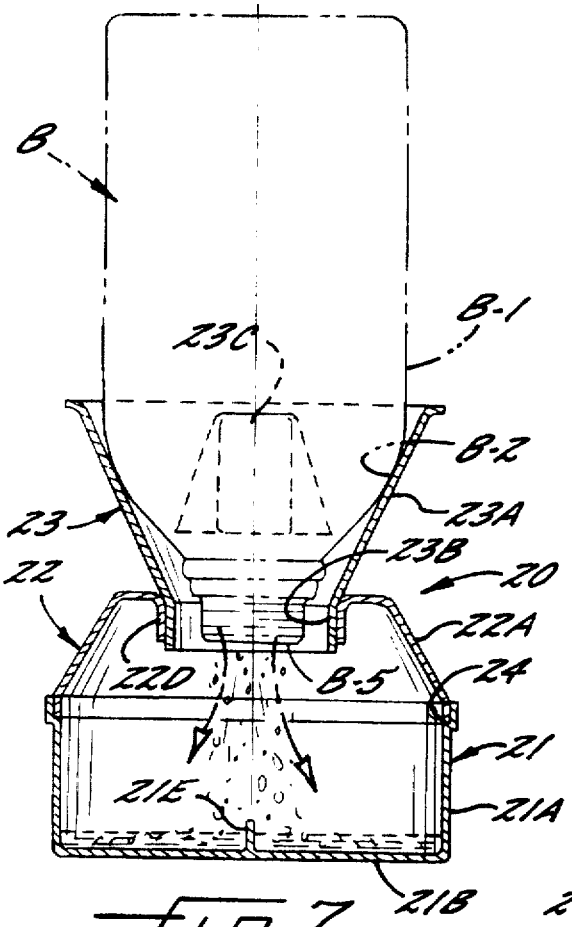
Figure 8:
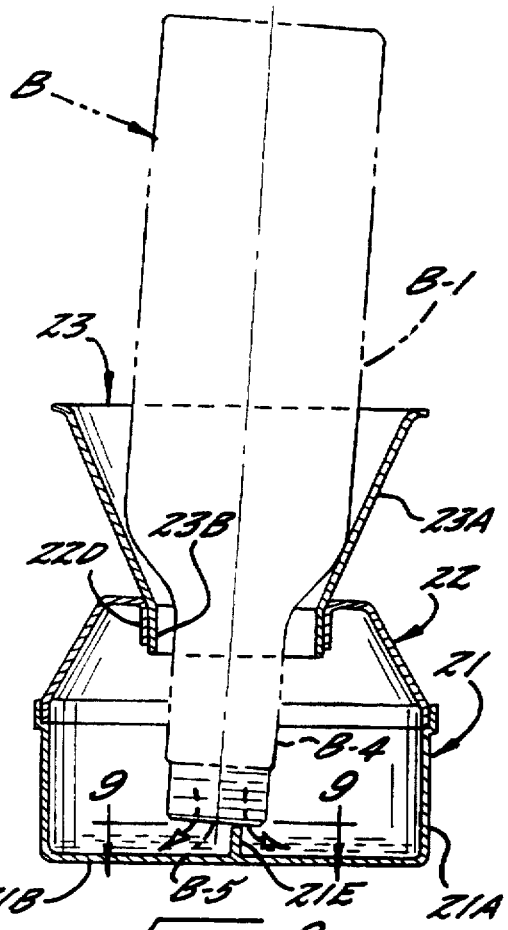
Figure 9:
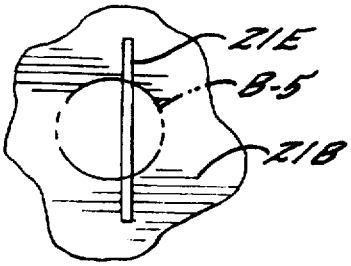
Figure 10:
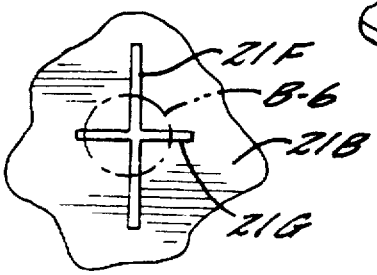
Figure 11:
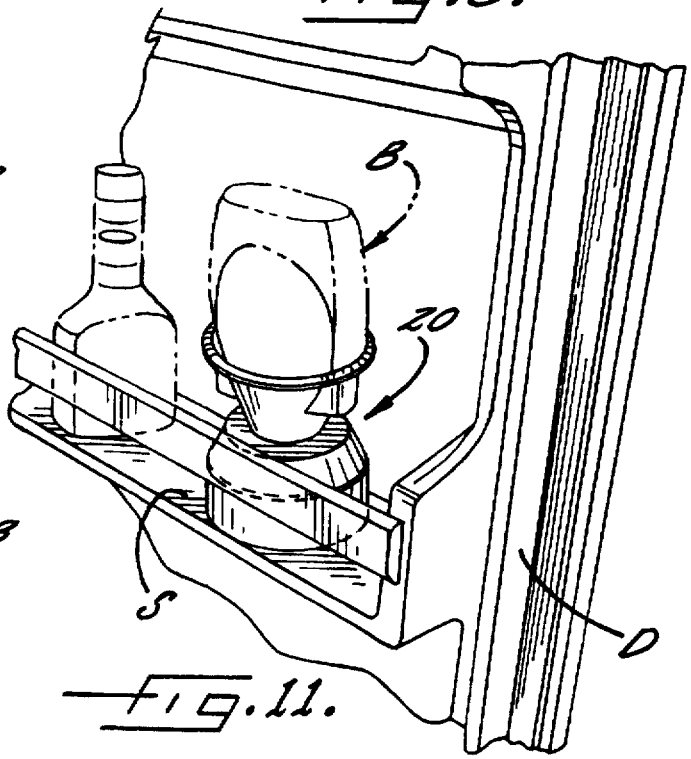
Figure 12:
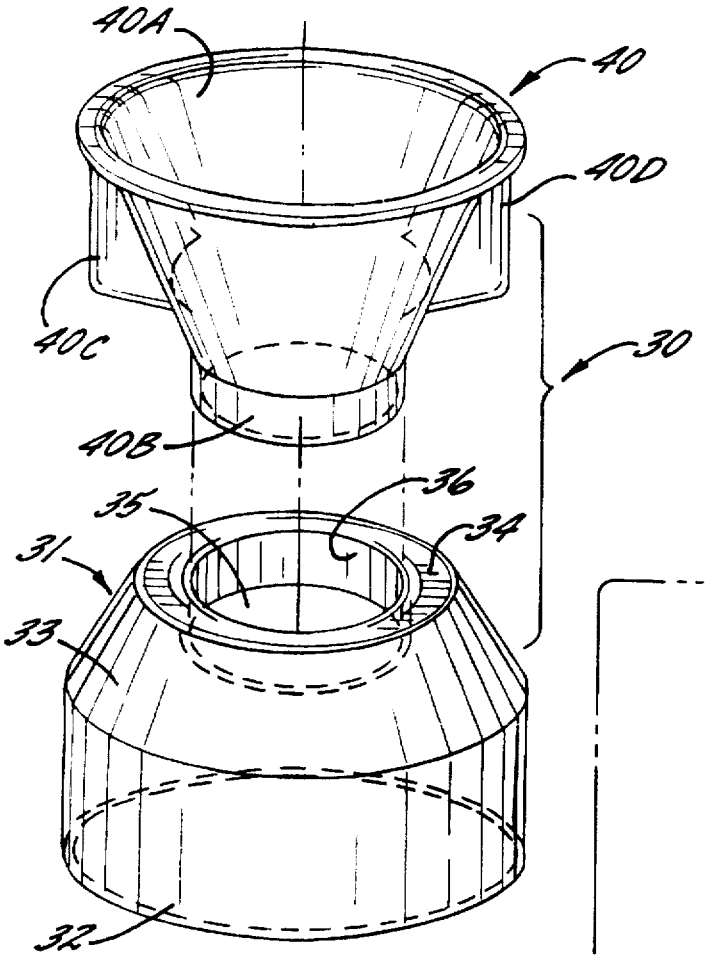
Figure 13:
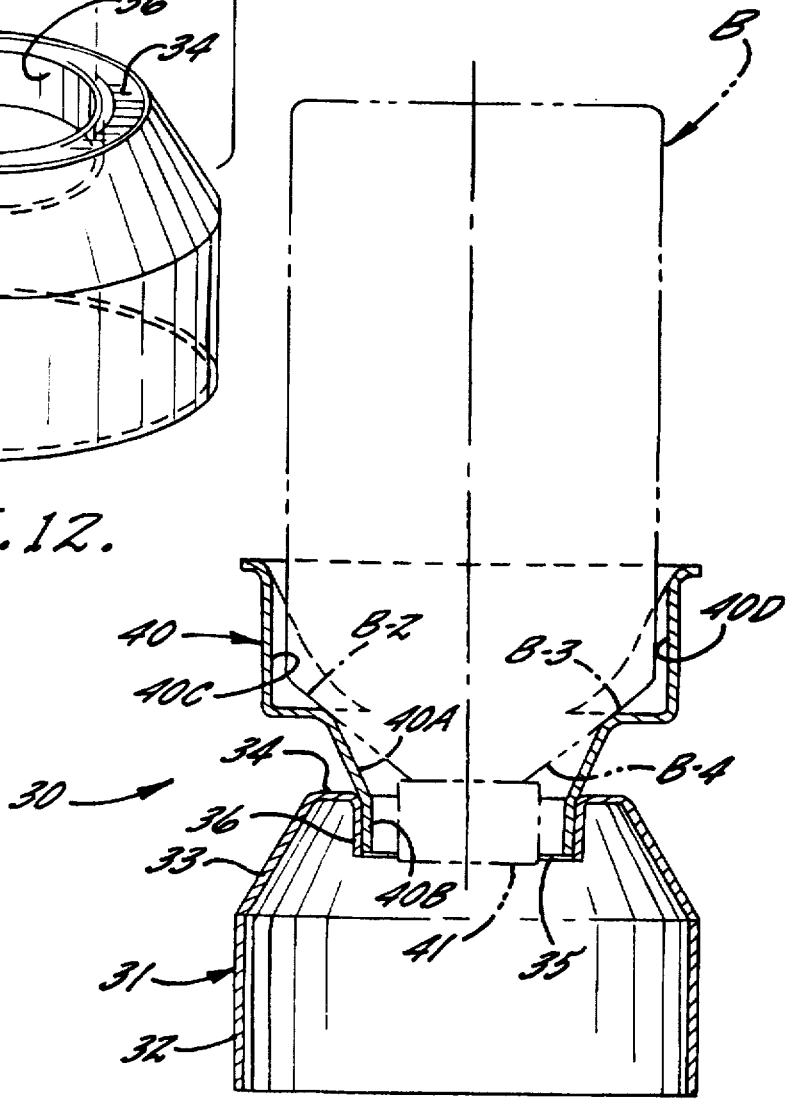

There are bottles of many sizes and shapes. Several of the foregoing patents disclose holders that will support different sizes of bottles, but not without disadvantages that are overcome by the present invention. The single tapered opening in the drain rack of Lee, for example, will support short-necked catsup bottles but not long-necked bottles of barbecue sauce. Lambert's funnel-shaped holder has to be hung from a support and can not be used in a refrigerator. Bradley and Connor provide holders with different sizes of openings to receive bottles of specific standard sizes, but not bottles that vary from the standard. The flexible baskets of FIG. 6 is a sectional view taken substantially along the line 6—6 in FIG. 5;

FIG. 7 is a sectional view of the holder shown in FIG. 5 but looking at one side of FIG. 5 and showing the holder supporting a different bottle than shown in FIG. 5;

FIG. 8 is a sectional view similar to FIG. 7 but showing the holder supporting a different bottle than shown in FIG. 7;

FIG. 9 is a sectional view taken substantially along the line 9—9 in FIG. 8;

FIG. 10 is a view similar to FIG. 9 but showing a modified abutment rising from the bottom of the base;

FIG. 11 is a perspective view showing the holder of FIG. 5 supporting an inverted bottle on a shelf in the door of a refrigerator;

FIG. 12 is an exploded perspective view of a second embodiment of the holder; and FIG. 13 is a vertical sectional view through FIG. 12 showing a closed bottle inverted and positioned in the holder to fill the neck of the bottle with a portion of its contents.

DETAILED DESCRIPTION OF THE INVENTION

Figure 1:
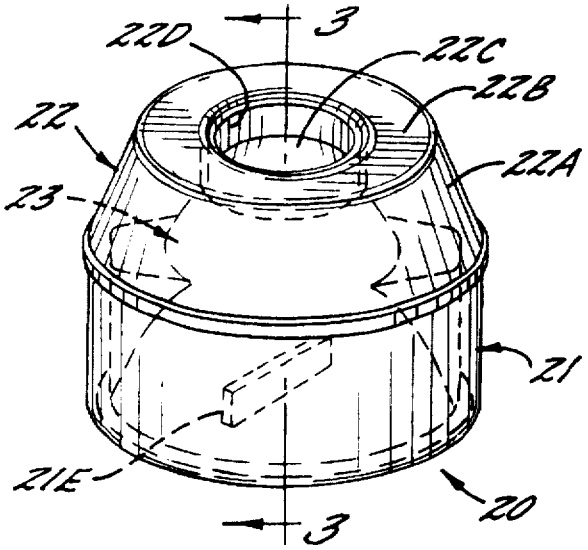
FIG. 1 is a perspective view of the first embodiment of the holder in its nested condition for shipping and storage and showing parts of the holder in phantom lines.
Figure 2:
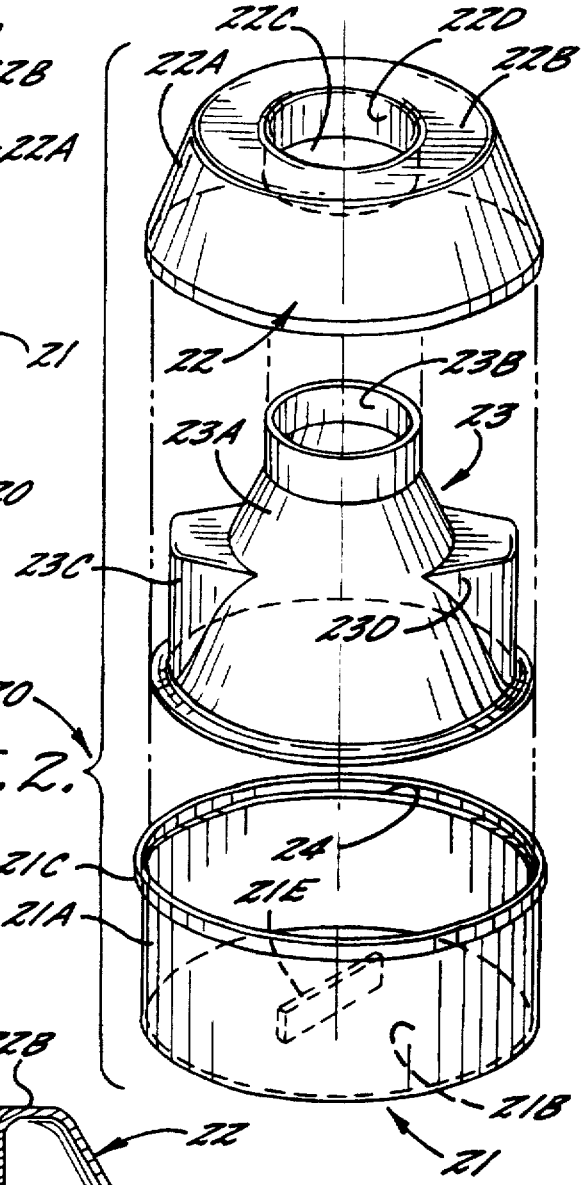
FIG. 2 is an exploded view of the parts of the holder that are nested together in FIG. 1.
Figure 3:
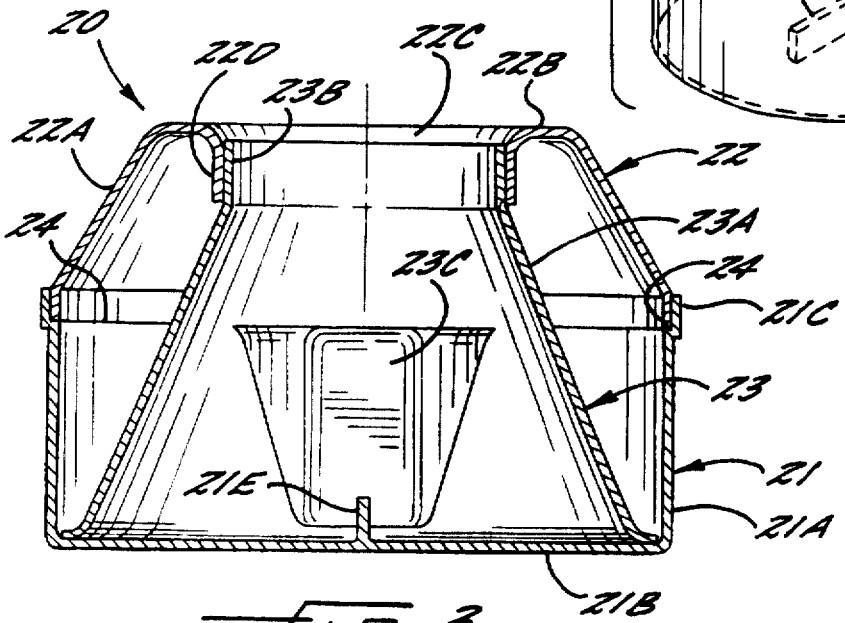
FIG. 3 is a sectional view taken substantially along the line 3—3 in FIG. 1.

A first embodiment of a holder for inverted bottles is broadly indicated at 20 in FIGS. 1–11. The holder 20 comprises a circular base 21, a mid-section 22, and an upper portion 23. When nested for shipping and storage, as shown in FIG. 1, the upper portion 23 is positioned within the base 21 and the mid-section 22 is seated on an annular ledge 24 within the base 21, enclosing the upper portion 23 for compact storage.

Figure 4:
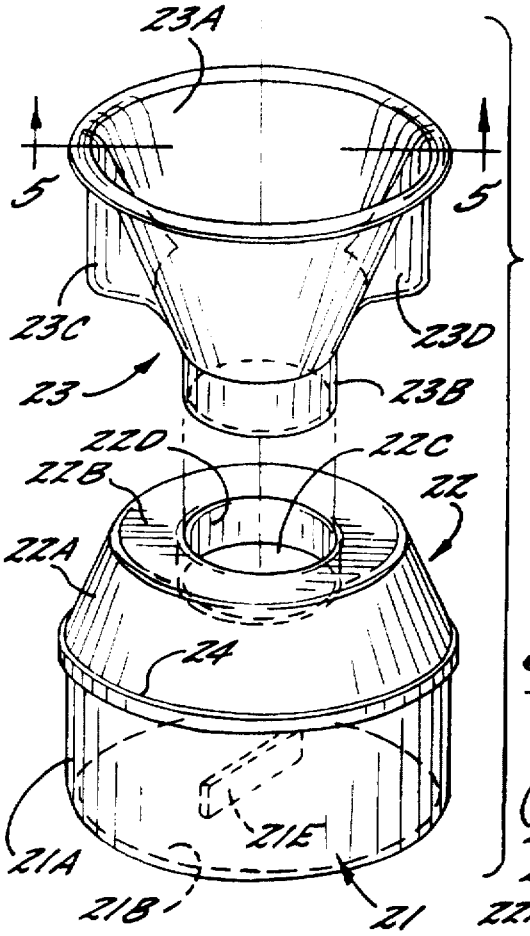
FIG. 4 is a partially exploded perspective view of the holder, illustrating its parts being assembled for use from the nested position of FIG. 1.

When assembled for use, the mid-section 22 and upper portion 23 are removed from the base 21 and the mid-section 22 is again seated on the annular flange 24 within the base, as shown in FIG. 4. The upper portion 23 is then seated in the mid-section 22.

The base 21 includes a circular sidewall 21 A rising from a bottom wall 21B. The sidewall 21A terminates at the ledge 24 which is defined by an annular flange 21C radially spaced and projecting upwardly from the sidewall 21A.

The mid-section 22 is shown in the drawings as including an upwardly and inwardly tapered circular sidewall 22A, whose lower edge is supported on the ledge 24 in the base 21. An annular top wall 22B extends inwardly from the upper edge of the sidewall 22A. The mid-section 22 has a circular opening 22C in the top wall 22B, defined by an annular rim 22D that extends downwardly in the drawings from the inner edge of the annular top wall 22B.

The upper portion 23 is formed with a circular sidewall 23A that tapers downwardly and inwardly in use like a funnel, as shown in FIGS. 4, 5, 7, 8 and 11, terminating at its lower end in an annular spout 23B. Diametrically opposed flanged portions 23C and 23D extend outwardly from the sidewall 23A and serve as auxiliary receptacles for the shoulders of bottles with generally rectangular body portions.

In use, as shown in FIGS. 4–8, the lower edge of the mid-section 22 is seated on the ledge 24. The spout 23B of the upper portion 23 is then seated in the opening 22C in the top of the mid-section 22 with the spout in snug engagement with the annular rim 22D that extends around the opening 22C, as best seen in FIG. 5, to provide stable support for a selected bottle, generally indicated at B.

FIGS. 5 and 6 illustrate use of the holder 20 for supporting an opened bottle B with a generally rectangular body portion, indicated at B-1. As seen in FIG. 5, the inverted bottle B is placed in the upper portion 23 of the holder 20 with the shoulders B-2 and B-3 of the bottle aligned with respective flange portions 23C and 23D in the upper portion 23, and the neck B-4 of the bottle extending through the spout 23B and opening 22C in the mid-section 22. As best seen in FIG. 6, the flanged portions 23C and 23D are complementary to the shape of the shoulders B-2 and B-3 and the snug fit restricts lateral motion of the bottle B.

The neck of the bottle shown in FIG. 5 is short enough so that the open end B-5 of the bottle is spaced above the bottom 21B of the base 21 when the inverted bottle is fully supported by the upper portion 23. So positioned, the contents of the bottle will freely drain into the base 21. Bottles with longer necks will extend all the way to the bottom 21 and engagement of a bottle's open end B-5 with the bottom wall 21B may restrict drainage of the bottle, except for the provision of an abutment 21E rising from the bottom wall 21B directly beneath the opening 22C.

As best seen in FIG. 8, the abutment 21E is placed directly in the path of any inverted bottle that is placed in the holder 20. One embodiment of the abutment 21E (FIG. 9) is a thin strip of plastic extending from the bottom wall 21B a sufficient distance to provide space for adequate drainage from the bottle when the open end B-5 of the bottle engages the abutment 21E.

FIG. 10 illustrates a modified abutment comprising perpendicularly arranged strips 21F and 21G. The function of the X-shaped cluster of strips 21F and 21G is to engage relatively thin bottle necks B-6 (FIG. 10) which might slip off an abutment formed from the single strip 21E.

FIG. 7 shows an inverted round bottle B with a short neck B-4 supported in the holder 20. The annular shoulder B-2 of the round bottle B is firmly seated against the tapered side wall 23A of the upper portion 23 and the round bottle does not engage the flanged portions 23C and 23D. The flanged portions are not used to support round bottles.

FIG. 11 shows the holder 20 supporting an inverted bottle B on a shelf S in the door D of a refrigerator. The holder 20 is also useful for supporting inverted bottles on tables, in pantries, and elsewhere as desired.

A second embodiment 30 of the holder is seen in FIGS. 12 and 13. As seen in FIG. 12, the second embodiment 30 includes an open ended base 31 with a circular wall 32 of sufficient diameter to provide stability to an inverted large bottle of catsup, for example. The upper portion 33 of the base 31 tapers inwardly to its juncture with a flat top wall 34 having a centrally located opening 35 defined by an annular rim 36 extending downwardly from the top wall 34 in FIG. 12.

An upper portion 40 of the second embodiment 30 is structurally the same as the upper portion 23 of the holder 20. Specifically, the upper portion 40 of the second embodiment 30 includes a circular sidewall 40A that tapers downwardly and inwardly in use like a funnel, as shown in FIGS. 12 and 13, terminating at its lower end in an annular spout 40B that fits snugly in the opening 35 against the annular rim 36. Diametrically opposed flanged portions 40C and 40D extend outwardly from the sidewall 40A and serve as auxiliary receptacles for the shoulders of bottles with generally rectangular body portions.

In use with a closed bottle B that has been inverted to collect part of its contents in the neck of the bottle, as seen in FIG. 13, the inverted bottle B is placed in the upper portion 40 of the holder 30 with the shoulders B-2 and B-3 of the bottle aligned with respective flange portions 40C and 40D in the upper portion 40, and the neck B-4 of the bottle extending through the spout 40B and the opening 35 in the base 31. The neck of the bottle B in FIG. 13 is closed by a cap 41 so there is no need for a bottom wall in the base 31.

There is thus provided two embodiments of a novel holder for inverted bottles which are capable of supporting an infinite variety of inverted bottles, whether opened or closed, and which may be compactly nested for storage and shipment.

Although specific terms have been used in describing the invention, they have been used in a generic and descriptive sense only and not for the purpose of limitation. The scope of the invention is found in the following claims.

I claim:

1. A holder for supporting any inverted bottle selected from a group of bottles wherein there are bottles of different sizes and shapes, the holder comprising:

(a) a base comprising a bottom wall and a continuous side wall extending from the bottom wall;

(b) an upper portion having an opening at one end and a spout at the other end of lesser diameter than the opening at said one end, the upper portion including a circular wall and means for supporting inverted bottles of different sizes and shapes, (c) a mid-portion shaped and sized at one end to receive the spout of the upper portion and shaped and sized at its opposite end to register with the side wall of the base, and (d) an abutment on the bottom wall of the base and in alinement with the spout in assembled relation, whereby inverted bottles that extend through the spout will be spaced from the bottom wall of the base for drainage.

2. A holder for supporting any inverted bottle selected from a group of bottles wherein there are bottles of different sizes and shapes, the holder comprising:

(a) a base comprising a continuous side wall;

(b) an upper portion having an opening at one end and a spout at the other end of lesser dimension than the opening at said one end, the upper portion including a circular side wall that extends from the opening at said one end of the upper portion to the spout on the other end of the upper portion, diametrically opposed flanged portions on the circular side wall, and (c) means supporting the spout of the upper portion on the side wall of the base.

3. A holder for supporting any inverted bottle selected from a group of bottles wherein there are bottles of different sizes and shapes, the holder comprising:

(a) a base comprising a continuous side wall and a bottom wall;

(b) an upper portion having an opening at one end and a spout at the other end of lesser dimension than the opening at said one end, the upper portion including a circular side wall that extends from the opening at said one end of the upper portion to the spout on the other end of the upper portion, diametrically opposed flanged portions on the circular side wall, (c) means supporting the spout of the upper portion on the side wall of the base, and (d) an abutment on the mid portion of the bottom wall of the base to support some bottles that extend through the spout of the upper portion.

* * * * *